United States Patent [19]

Mills

[11] 4,222,753

[45] Sep. 16, 1980

[54] SUCTION CLEANER

[76] Inventor: Robert G. Mills, 11 Forest Close, Red Deer, Alberta, Canada

[21] Appl. No.: 913,091

[22] Filed: Jun. 6, 1978

[30] Foreign Application Priority Data

Jun. 2, 1978 [CA] Canada ..... 304648

[51] Int. Cl.[2] ..... B01D 46/00

[52] U.S. Cl. ..... 55/274; 15/327 D; 55/378; 55/467; 220/300; 220/304; 285/361

[58] Field of Search ..... 55/274, 357, 366, 378, 55/467, 428, 471, 429, 472, 502; 15/327 D; 285/424, 401, 361, 376, 360, 391; 220/300, 304

[56] References Cited

U.S. PATENT DOCUMENTS

| | | | |
|---|---|---|---|
| Re. 18,822 | 5/1933 | Paine | 55/378 |
| 1,458,602 | 6/1923 | Upton | 55/429 |
| 1,461,173 | 7/1923 | Bennett | 55/429 |
| 1,515,560 | 11/1924 | Elwell | 220/300 |
| 2,295,984 | 9/1942 | Wilson | 55/357 |
| 3,365,864 | 1/1968 | Iizima | 55/471 |
| 3,570,222 | 3/1971 | Dudek et al. | 55/472 |
| 3,676,986 | 7/1972 | Reiling | 55/472 |

FOREIGN PATENT DOCUMENTS

| | | | |
|---|---|---|---|
| 249875 | 3/1926 | United Kingdom | 55/274 |
| 304971 | 1/1929 | United Kingdom | 220/300 |

OTHER PUBLICATIONS

Cambridge Absolute Filter Vacuum Cleaners, Syracuse, New York, pp. 1–4, Oct. 1963.

*Primary Examiner*—Bernard Nozick
*Attorney, Agent, or Firm*—Dennison, Dennison, Meserole & Pollack

[57] ABSTRACT

A built-in suction cleaner has a waste bucket of translucent material to permit its contents to be seen. The bucket has handles and is secured to a body section by co-operating projections and recesses, facilitating removal and replacement of the bucket. A filter in the body section is secured by a spring band in the filter edge being received within a groove in the body section wall. The body section supports a suction unit, which is resiliently secured in place only by a cover being fixed to the body section.

4 Claims, 2 Drawing Figures

SUCTION CLEANER

Figure 1:
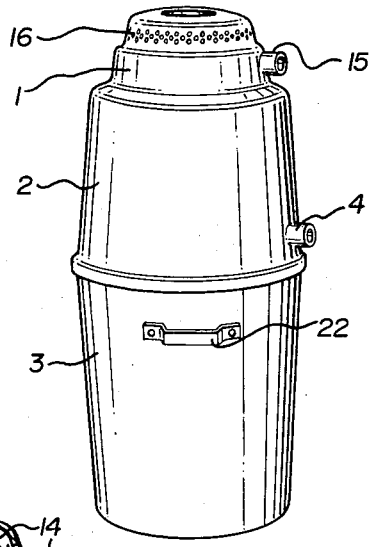

This invention relates to suction cleaners, and in particular to such cleaners of the so-called built-in type.

It is known to provide in a building a suction cleaner which is "built-in", i.e. fixed in a permanent position, and whose inlet is connected by ducts to various parts of the building. Such cleaners generally comprise a body section which encloses a motor driven suction unit and an air filter, and a bucket, which is disposed beneath the body section and is removable therefrom, into which waste material sucked in by the cleaner falls. Generally, the bucket is secured to the body section by externally mounted metal clip-on catches.

Such known cleaners have the disadvantage that it is necessary to remove the bucket in order to determine how full it is, and it is difficult to remove the bucket, this operation requiring a person to balance on one leg with the knee of the other leg supporting the bucket while the hands are used to undo the catches. It is equally difficult to replace the bucket. The difficulty of these operations may lead to damage being caused to the seal provided between the bucket and the body section upon removal and replacement of the bucket, or may cause the bucket to be emptied infrequently leading to inefficient or faulty operation of the cleaner.

This invention seeks to provide a suction cleaner in which the above-described disadvantages are avoided or at least substantially reduced.

According to the present invention there is provided a suction cleaner comprising a suction unit, a body section including a suction inlet, and a bucket adapted to be secured to the body section beneath the body section to collect waste matter sucked into the cleaner through the inlet, the bucket having means externally thereof to permit said bucket to be supported and rotated relative to the body section, and co-operable cam means on the body section and bucket adapted to secure the same together and to release the bucket from the body section upon rotation of the bucket relative to the body section, said cam means including a plurality of camming surfaces inclined from the horizontal axis of said cleaner whereby rotation of said bucket with respect to said body section will cause relative axial movement between said body section and the bucket.

A suction cleaner according to the invention enables easy removal and replacement of the bucket in that the handles are used for rotating the bucket to secure it to or release it from the body section, and at the same time ensure that the bucket is gripped and thereby supported. Furthermore, the handles facilitate carrying the bucket when it is removed from the body section.

The bucket preferably comprises a translucent material; conveniently the entire bucket, except possibly for the handles, is of translucent material, but it is conceivable that only a part of the bucket is of such material. This material permits the level of waste matter in the bucket to be inspected without the bucket being removed from the body section. Consequently it is easy to determine when the bucket should be emptied.

A further disadvantage of the known cleaners referred to above is that the air filter thereof is not easily removable for inspection, cleaning, or replacement. In an embodiment of the invention, this disadvantage is overcome by providing the body section with a recess on an internal wall thereof; in this case the cleaner further comprises a filter having a resilient periphery adapted to be received within the recess thereby to retain the filter within the body section. The resilient periphery can be in the form of, for example, a spring steel band sewn into the edge of the filter. The filter is then readily removed from and replaced within the body section by displacing the resilient periphery thereof inwardly.

Preferably the body section includes a resilient support for the suction unit, the cleaner further comprising a cover for the suction unit adapted to be secured to the body section so as to bear resiliently against the suction unit to retain the suction unit on the body section. This construction avoids any need for the suction unit to be fixed to the body section, facilitating access to and replacement of the suction unit.

In a preferred embodiment of the invention, the cooperable securing means comprises a plurality of projections equally spaced around the upper external periphery of the bucket and a like plurality of recesses, adapted to receive said projections, equally spaced around the lower internal periphery of the body section, the projections and recesses being such that rotation of the bucket relative to the body section with the projections engaged in the recesses causes the bucket to be drawn upwardly relative to the body section and secured thereto.

The invention will be further understood from the following description by way of example of an embodiment thereof with reference to the accompanying drawings, in which:

FIG. 1 illustrates a general view of a suction cleaner; and

Figure 2:
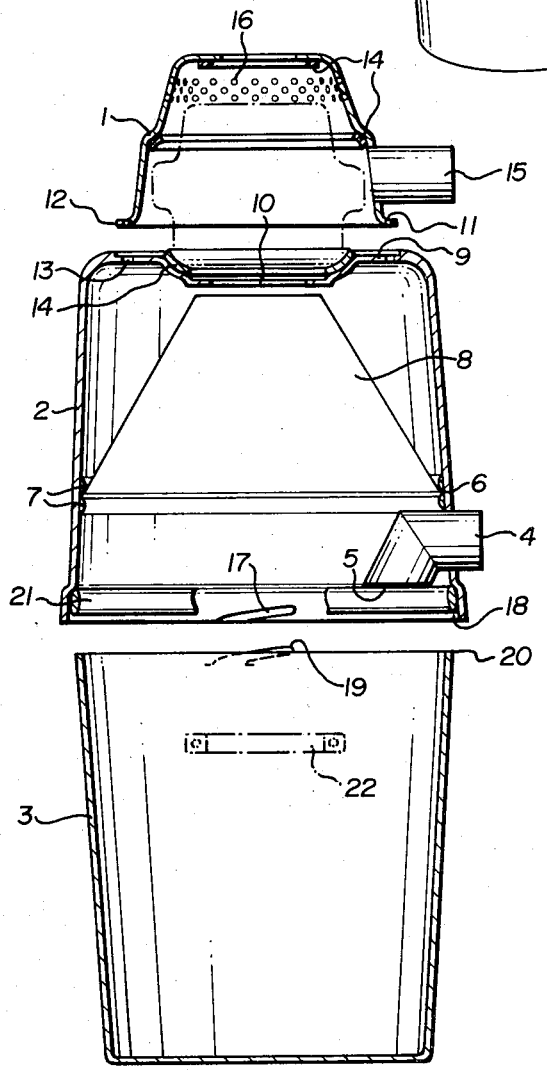

FIG. 2 schematically illustrates in section and in exploded form the suction unit cover, the body section, and the bucket of the suction cleaner shown in FIG. 1.

Referring to the drawings, the suction cleaner shown therein comprises a suction unit cover 1, a body section 2, and a bucket 3, all of polycarbonate plastic material. The cover 1 and body section 2 are colored and opaque, and the bucket 3 is translucent to enable the level of its contents to be readily determined.

The body section 2 includes a suction inlet 4 having an open end 5 within the body section 2 which faces downwardly towards the bucket 3. The body section 2 has provided on its internal wall a groove or recess 6, which in this case is defined between ridges 7 formed on the body section wall. Within this recess 6 the resilient periphery of an air filter 8 is received to retain the filter 8 in the position shown in FIG. 2. The filter 8 is for example a woven cotton filter having an anti-static liner and having a spring steel band sewn into its edge to form the resilient periphery. Deformation of the spring steel band inwardly enables the filter 8 to be readily removed from or placed in the recess 6.

An upper wall 9 of the body section 2 is shaped to provide a support for a suction unit, shown in phantom lines, of the suction cleaner, the suction unit comprising an electric motor and a fan unit arranged to be driven thereby to provide a desired suction through a central aperture 10 in the upper wall 9. The suction unit cover 1 can be secured to the body section 2 by means of bolts or screws (not shown) which pass through holes 11 in a flange 12 of the cover 1 to engage with holes 13, which may for example be threaded, in the wall 9. When the suction unit cover 1 is so secured to the body section 2 with the suction unit in place, the suction unit is resiliently held in position in that rubber gaskets 14, two provided on the cover 1 and one provided on the wall 9, are compressed between parts of the suction unit and the cover 1 and wall 9 respectively. This resilient mounting of the suction unit holds the suction unit in position without requiring any other means for mounting the suction unit, and assists in preventing transmission of vibration to the suction cleaner housing. As no other suction unit mounting means is provided, access to the suction unit for servicing and replacement is a very simple matter merely requiring removal of the cover 1.

The cover 1 is also provided with an exhaust outlet 15 and motor-cooling vent holes 16.

The body section 2 is provided with two opposite recesses 17, one of which is shown in FIG. 2, on its lower internal periphery 18, each of which recesses is open at the edge of the body section 2 and is inclined upwardly therefrom. The bucket 3 is provided, on its upper external periphery, with two opposite projections 19, one of which is visible in FIG. 2 through the translucent wall of the bucket 3. The projections 19 and recesses 17 serve as securing means and are adapted to co-operate with one another so that the bucket 3 can be lifted to a position in which the projections 19 are able to enter the recesses 17, from which position rotation of the bucket 3 in the appropriate direction causes the bucket 3 to be drawn upwardly relative to the body section 2. The projections 19 and the recesses 17 thus co-operate to secure the bucket 3 to the body section 2, in a position in which the upper edge 20 of the bucket 3 is received within the lower periphery 18 of the body section 2 and bears against a resilient seal 21 provided within this lower periphery 18. The seal 21 ensures that the bucket 3 is secured to the body section 2 in an air-tight manner, which is necessary for efficient operation of the suction cleaner.

To facilitate lifting and rotating the bucket 3 to secure it to and remove it from the body section 2, the bucket 3 is provided on opposite sides with handles 22, one of which can be seen through the bucket 3 in FIG. 2.

It should be appreciated that the features of the suction cleaner described above provide many advantages. In particular, the construction of the cleaner is such that relatively few parts are required, reducing production costs and facilitating servicing. The body section, suction unit cover, and bucket are of plastic materials, so that they are readily produced at low cost. The translucent nature of the bucket enables the level of its contents to be determined without the bucket being removed from the body section, this contributing significantly to convenience of operation of the cleaner. This also ensures that the bucket is removed and emptied only when necessary, this leading to improved efficiency of operation in that overfilling of the bucket is less likely to occur and the air-tight seal between the bucket and the body section is subjected to less wear. Furthermore, the arrangement of handles on the bucket and the securing means for securing the bucket to the body section enable the bucket to be readily removed and replaced.

The invention is not limited by the above description, which is by way of example only. For example, different numbers of handles and co-operating projections and recesses could be provided; the projections and recesses could be provided on the body section and the bucket respectively; or different forms of securing means could be provided. Accordingly, many modifications may be made without departing from the scope of the invention as defined by the appended claims.

I claim:

1. A suction cleaner comprising a suction unit, a body section including a suction inlet, and a bucket adapted to be secured to the body section beneath the same to collect waste matter sucked into the cleaner through the inlet, the bucket having handle means externally thereof to permit said bucket to be manually supported and rotated relative to the body section, a plurality of cooperable securing means, one portion of said securing means being disposed on the upper external periphery of said bucket and a second cooperating portion being disposed around the lower internal periphery of said body section, said portions cooperating to secure the bucket to the body section and to release the bucket therefrom upon rotation of the bucket relative to the body section, one of said securing means portions comprising a plurality of circumferentially spaced cam slots inclined to the horizontal axis of said cleaner, the other of said securing means portions comprising a plurality of mating cam lip projections also inclined to said horizontal axis, whereby when said two portions are engaged and said bucket is rotated relative to said body section, the bucket will move axially, and a resilient gasket provided within said body section and spaced inwardly from the lower peripheral edge thereof, said securing means portions being initially engageable prior to any deformation of said gasket due to said spacing and thereafter being deformable upon further rotation of said bucket to provide a seal between said bucket and body section.

2. A suction cleaner as claimed in claim 1 wherein at least part of said bucket is formed from a translucent material.

3. A suction cleaner as claimed in claim 1 wherein the body section includes a recess provided on an internal wall thereof, the cleaner further comprising a filter having a resilient periphery adapted to be received within said recess thereby to retain the filter within the body section.

4. A suction cleaner as claimed in claim 1, wherein the body section includes a resilient support for the suction unit, the cleaner further comprising a cover for the suction unit adapted to be secured to the body section so as to bear resiliently against the suction unit to retain the suction unit on the body section.

* * * * *